US008690987B2

(12) United States Patent
Sato et al.

(10) Patent No.: US 8,690,987 B2
(45) Date of Patent: Apr. 8, 2014

(54) METHOD AND APPARATUS FOR PRODUCING CARBON IRON COMPOSITE

(75) Inventors: Takeshi Sato, Chiba (JP); Tetsuya Yamamoto, Hiroshima (JP); Hidekazu Fujimoto, Kanagawa (JP); Takashi Anyashiki, Kanagawa (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 13/389,494

(22) PCT Filed: Jul. 28, 2010

(86) PCT No.: PCT/JP2010/063143

§ 371 (c)(1),
(2), (4) Date: May 1, 2012

(87) PCT Pub. No.: WO2011/018964

PCT Pub. Date: Feb. 17, 2011

(65) Prior Publication Data

US 2012/0204678 A1 Aug. 16, 2012

(30) Foreign Application Priority Data

Aug. 10, 2009 (JP) ..... 2009-185410
Jul. 27, 2010 (JP) ..... 2010-167786

(51) Int. Cl.
*C22B 1/02* (2006.01)
*F27D 3/00* (2006.01)

(52) U.S. Cl.
USPC ..... 75/503; 75/489; 75/504; 75/505; 423/439

(58) Field of Classification Search
USPC ..... 423/439; 75/503, 504, 505, 489
See application file for complete search history.

(56) References Cited

FOREIGN PATENT DOCUMENTS

| | | | | |
|---|---|---|---|---|
| JP | 52-023102 | A | 2/1977 | |
| JP | 52-023107 | A | 2/1977 | |
| JP | 54 062203 | A | 5/1979 | |
| JP | 6-065579 | A | 3/1994 | |
| JP | 7 188667 | A | 7/1995 | |
| JP | 2004359718 | A * | 12/2004 | ..... C10B 53/08 |
| JP | 4078771 | B2 | 4/2008 | |
| JP | 4218426 | B2 | 2/2009 | |
| JP | 2010 202838 | A | 9/2010 | |
| WO | 2011/122535 | A1 | 10/2011 | |

OTHER PUBLICATIONS

Machine translation of JP 2004-359718 by Okada et al, published Dec. 24, 2004.*

"Kokusu Gijutsu Nenpou (annual report on coke technology)," *Fuel Society of Japan*, 1958, cover and index and pp. 35-41 (1 page of partial English translation).

Anyashiki, T. et al.,"Development of Carbon Iron Composite Process," *JFE Technical Report*, May 1, 2009, pp. 1-6.

* cited by examiner

*Primary Examiner* — George Wyszomierski
*Assistant Examiner* — Tima M McGuthry Banks
(74) *Attorney, Agent, or Firm* — DLA Piper LLP (US)

(57) ABSTRACT

Carbon iron composite is produced by feeding a formed product of a carbon-containing substance and an iron-containing substance into a carbonization furnace, carbonizing the formed product in a carbonization zone, blowing a coolant gas into the furnace through a coolant-gas-blowing tuyere disposed in a cooling zone to cool carbon iron composite, exhausting a furnace gas through an outlet in a top portion, and discharging the carbon iron composite through a lower portion of the cooling zone.

9 Claims, 7 Drawing Sheets

PRIOR ART

METHOD AND APPARATUS FOR PRODUCING CARBON IRON COMPOSITE

RELATED APPLICATIONS

This is a §371 of International Application No. PCT/JP2010/063143, with an international filing date of Jul. 28, 2010 (WO 2011/018964 A1, published Feb. 17, 2011), which is based on Japanese Patent Application Nos. 2009-185410, filed Aug. 10, 2009, and 2010-167786, filed Jul. 27, 2010, the subject matter of which is incorporated by reference.

TECHNICAL FIELD

This disclosure relates to a method and an apparatus for producing carbon iron composite (ferrocoke) in which a formed product of a carbon-containing substance and an iron-containing substance is continuously carbonized in a vertical carbonization furnace to produce metallic iron in coke.

BACKGROUND

Metallurgical coke produced by coal carbonized in a coke oven is generally used in the operation of a blast furnace. In recent years, from the viewpoint of improving the reactivity of coke, there has been known a technique for using metallurgical carbon iron composite produced by carbonizing a mixture of coal and iron ore in the operation of a blast furnace. Carbon iron composite can increase the $CO_2$ reactivity of coke in the carbon iron composite by the catalytic effect of reduced iron ore and can decrease the percentage of a reducing material as a result of a decrease in thermal reserve zone temperature.

Studies have been carried out on a technique for carbonizing a carbon-containing substance such as coal, and an iron-containing substance such as iron ore, in a common chamber coke oven to produce carbon iron composite, for example, a) a method for feeding a mixture of coal and iron ore fines into a chamber coke oven or b) a method for cold-forming coal and iron ore at room temperature and feeding the formed product into a chamber coke oven (see, for example, Fuel Society of Japan, "Kokusu Gijutsu Nenpou (annual report on coke technology)," 1958, p. 38).

However, since conventional coke ovens are constructed of silica stone bricks, iron ore in a chamber coke oven can react with the main component of the silica stone bricks, silica, to form low-melting-point fayalite, causing damage to the silica stone bricks. Thus, a technique for producing carbon iron composite in a chamber coke oven has not been industrially employed.

As a substitute for a method for producing coke in a chamber oven, a method for continuously producing formed coke has been developed. In the method for continuously producing formed coke, a vertical shaft furnace constructed of chamotte bricks in place of silica stone bricks is used as a carbonization furnace. Coal is cold-formed in a predetermined size and fed into a vertical shaft furnace. The briquettes are carbonized by heating with a circulating heating gas to produce formed coke. It has been demonstrated that coke having a strength comparable to that of coke produced with a conventional coke oven can be produced even by using a large amount of naturally abundant and inexpensive non- or slightly-caking coal.

One known method for continuously producing formed coke is characterized in that a top gas of a vertical carbonization furnace is utilized as a coolant gas into a lower portion of a cooling chamber directly coupled to a carbonization chamber of the vertical carbonization furnace. Most of the gas passing through the cooling chamber is exhausted from an upper portion of the cooling chamber and supplied as a heating gas to an inlet in an intermediate portion of the carbonization furnace (see, for example, Japanese Examined Patent Application Publication No. 56-47234). This method requires three gas inlets (an intermediate portion of the carbonization chamber, a lower portion of the carbonization chamber, and a lower portion of the cooling chamber) and one gas outlet (an upper portion of the cooling chamber), which makes the equipment complicated. Sensible heat generated by the cooling of high-temperature coke after carbonization is recovered with a gas and reused by supplying the heat to an intermediate portion of the carbonization furnace. However, there is a problem of heat loss. To simplify the equipment, another method for producing formed coke is disclosed which does not require the removal of gas from an intermediate portion of a vertical carbonization furnace (see Japanese Unexamined Patent Application Publication No. 52-23107). In accordance with that method, coke after carbonization is cooled in a water tank instead of using a gas. One of characteristics of carbon iron composite is that iron ore can be reduced to metallic iron during carbonization, and its catalytic effect can increase reactivity. A water cooling method may cause reoxidation of metallic iron and therefore cannot be employed for the production of carbon iron composite.

As described above, chamber coke ovens constructed of silica stone bricks are difficult to use in the production of carbon iron composite. It is therefore desirable to use a vertical carbonization furnace having multiple tuyeres using the same type of gas as in formed coke as a heating medium, for example, a vertical shaft furnace constructed of chamotte bricks. However, considering the use of a vertical continuous carbonization furnace having a cooling function, a conventional carbonization furnace for formed coke requires gas removal at some point of the furnace which makes the equipment complicated. Furthermore, carbon iron composite requires the reduction of an iron-containing substance. Thus, a conventional method for producing formed coke cannot be directly used for carbon iron composite. The operational specifications such as gas distribution in tuyeres must be reconsidered. Furthermore, energy conservation cannot be avoided in future iron-manufacturing processes, necessitating a design concept of minimizing energy required for the production of carbon iron composite.

Accordingly, it could be helpful to provide a method and an apparatus for producing carbon iron composite in which production of metallurgical carbon iron composite with a vertical carbonization furnace can be performed with simplified equipment with decreased energy consumption.

SUMMARY

We thus provide:

(1) A method for producing carbon iron composite, including the steps of:

- providing a carbonization furnace having a top portion, a carbonization zone in an upper portion, and a cooling zone in a lower portion;
- feeding a formed product of a carbon-containing substance and an iron-containing substance into a carbonization furnace;
- carbonizing the formed product in the carbonization zone to produce carbon iron composite;
- blowing a coolant gas into the furnace through a coolant-gas-blowing tuyere disposed in the cooling zone to cool the carbon iron composite; and exhausting a furnace gas through an outlet in the top portion, wherein the carbonization involves supplying the coolant gas after the coolant gas has undergone heat exchange with the carbon iron composite in the cooling zone to the carbonization zone, blowing a high-temperature gas into the furnace through a high-temperature-gas-blowing tuyere disposed in a lower portion of the carbonization zone, and blowing a low-temperature gas into the furnace through a low-temperature-gas-blowing tuyere disposed in an intermediate portion of the carbonization zone.

(2) The method for producing carbon iron composite according to (1), wherein the furnace gas is exhausted only through the outlet in the top portion.

(3) The method for producing carbon iron composite according to (1), further including supplying the furnace gas exhausted through the outlet in the top portion to the low-temperature-gas-blowing tuyere.

(4) The method for producing carbon iron composite according to (1), further including supplying the furnace gas exhausted through the outlet in the top portion to the high-temperature-gas-blowing tuyere.

(5) The method for producing carbon iron composite according to (1), further including supplying the furnace gas exhausted through the outlet in the top portion to the coolant-gas-blowing tuyere.

(6) The method for producing carbon iron composite according to (1), further including supplying the furnace gas exhausted through the outlet in the top portion to the low-temperature-gas-blowing tuyere, the high-temperature-gas-blowing tuyere, and the coolant-gas-blowing tuyere.

(7) The method for producing carbon iron composite according to (1), wherein the gas blown into the furnace through the low-temperature-gas-blowing tuyere has a temperature in the range of 400° C. to 700° C.

(8) The method for producing carbon iron composite according to (1), wherein the gas blown into the furnace through the high-temperature-gas-blowing tuyere has a temperature in the range of 800° C. to 1000° C.

(9) The method for producing carbon iron composite according to (1), wherein the gas blown into the furnace through the coolant-gas-blowing tuyere has a temperature in the range of 25° C. to 80° C.

(10) An apparatus for carbonizing a formed product of a carbon-containing substance and an iron-containing substance to continuously produce carbon iron composite, the apparatus including:

a carbonization furnace main body having a carbonization zone for carbonizing the formed product in an upper portion and a cooling zone for cooling the formed product in a lower portion;

a charging port for charging the formed product into the furnace, the charging port being disposed in a top portion of the carbonization furnace main body;

a low-temperature-gas-blowing tuyere for blowing a low-temperature gas into the furnace to heat the formed product, the low-temperature-gas-blowing tuyere being disposed in an intermediate portion of the carbonization zone;

a high-temperature-gas-blowing tuyere for blowing a high-temperature gas into the furnace to heat the formed product, the high-temperature-gas-blowing tuyere being disposed in a lower portion of the carbonization zone;

a coolant-gas-blowing tuyere for blowing a coolant gas for cooling carbon iron composite into the furnace, the coolant-gas-blowing tuyere being disposed in a lower portion of the cooling zone, the blown coolant gas flowing to the cooling zone and the carbonization zone;

a furnace gas outlet for exhausting a furnace gas, the furnace gas outlet being disposed in the top portion of the carbonization furnace main body; and a carbon iron composite outlet disposed in a lower portion of the carbonization furnace main body.

(11) The apparatus for producing carbon iron composite according to (10), wherein the furnace gas is exhausted only through the outlet in the top portion.

(12) The apparatus for producing carbon iron composite according to (10), wherein the horizontal cross-sectional area of the carbonization furnace main body at the position of the coolant-gas-blowing tuyere is substantially the same as the horizontal cross-sectional area of the carbonization furnace main body at the position of the high-temperature-gas-blowing tuyere.

Carbon iron composite can be continuously produced with simplified equipment with decreased energy consumption. Thus, reactive carbon iron composite can be used in the operation of a blast furnace, thereby effectively decreasing the percentage of a reducing material.

Figure 1:
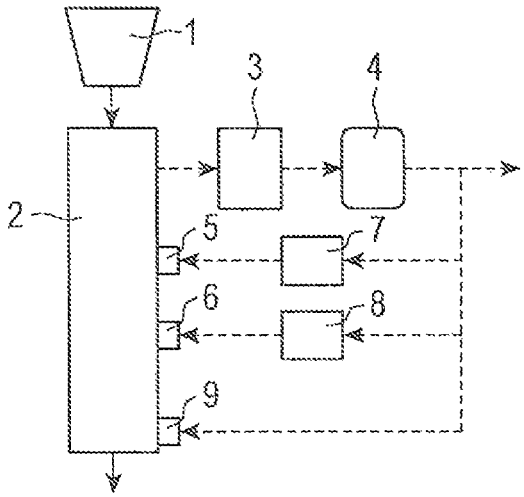
FIG. 1 is a schematic view of an example of our apparatus.

| Explanation of Reference Numerals | |
|---|---|
| 1 | Formed product feeder |
| 2 | Vertical carbonization furnace main body |
| 3 | Circulating gas cooler |
| 4 | Circulating gas cooler |
| 5 | Low-temperature-gas-blowing tuyere |
| 6 | High-temperature-gas-blowing tuyere |
| 7 | Low-temperature gas heater |
| 8 | High-temperature gas heater |
| 9 | Coolant-gas-blowing tuyere |
| 10 | Coolant-gas-removal tuyere |
| A | Position of low-temperature-gas-blowing tuyere |
| B | Position of high-temperature-gas-blowing tuyere |
| C | Position of coolant-gas-removal tuyere |
| D | Position of coolant-gas-blowing tuyere |
| E | Stock line |

DETAILED DESCRIPTION

Figure 2:
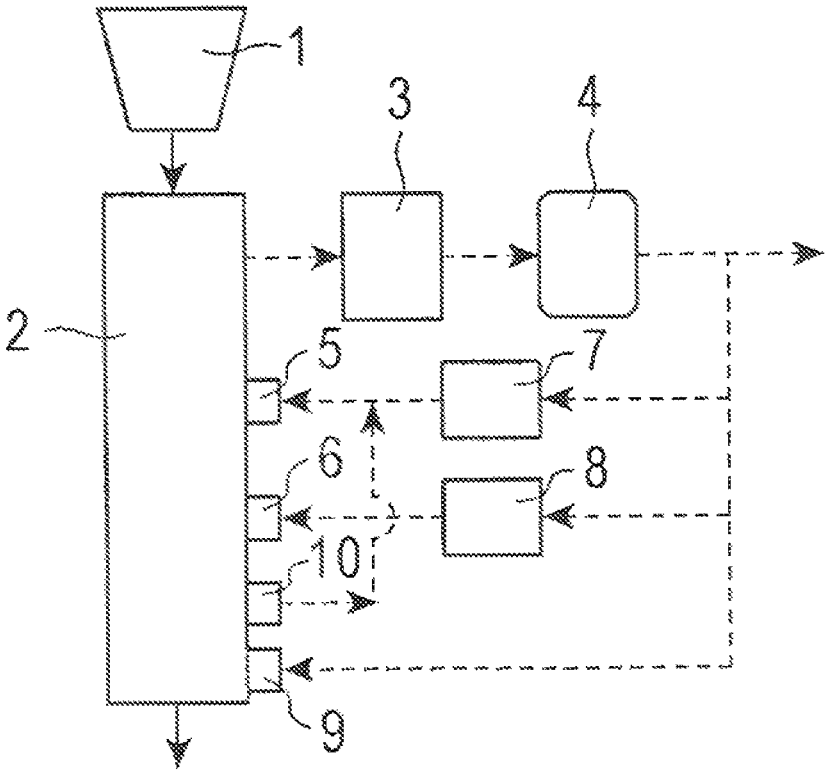
FIG. 2 is a schematic view of an example of a comparative apparatus.

As described above, we concluded that vertical continuous carbonization furnaces having a cooling function are more suitable for production of carbon iron composite than chamber coke ovens. As illustrated in FIG. 2, a conventional carbonization furnace for formed coke requires gas removal through a coolant-gas-removal tuyere 10 at some point of a carbonization furnace main body 2. This makes the equipment complicated. The gas to be removed is a high-temperature gas heated by heat exchange with high-temperature coke after carbonization. In this formed coke production process, the heated high-temperature gas is reused by introducing it into an intermediate portion of the carbonization furnace through a low-temperature-gas-blowing tuyere 5. However, this may cause heat loss. Furthermore, production of carbon iron composite requires reduction of iron oxide as well as carbonization of coal. Thus, production of carbon iron composite requires a larger amount of heat than production of formed coke in a high temperature portion in which reduction of iron oxide is activated. It is probably inappropriate in terms of heat balance to temporarily remove a high-temperature gas from the furnace and reuse it in a low-temperature portion (an intermediate portion of the carbonization furnace) as in production of formed coke.

Thus, in production of carbon iron composite containing metallic iron by continuously carbonizing a formed product of a carbon-containing substance and an iron-containing substance in a vertical carbonization furnace to produce metallic iron in coke, we employ simplified equipment to produce carbon iron composite in which an upper portion of the vertical carbonization furnace serves as a carbonization zone, a lower portion serves as a cooling zone, a heating medium gas is supplied from three points, that is, an intermediate portion and a lower portion of the carbonization zone and a lower portion of the cooling zone, a furnace gas is exhausted only through a top portion, and thereby a coolant-gas-removal tuyere installed in production of formed coke is eliminated. FIG. 1 illustrates an example of such equipment.

In FIG. 1, the equipment for producing carbon iron composite includes a carbonization furnace having a carbonization zone that carbonizes a formed product in an upper portion and a cooling zone that cools carbon iron composite in a lower portion. On the side of the carbonization furnace 2, a low-temperature-gas-blowing tuyere 5 is disposed in a position corresponding to an intermediate portion of the carbonization zone, a high-temperature-gas-blowing tuyere 6 is disposed in a position corresponding to a lower portion of the carbonization zone, a coolant-gas-blowing tuyere 9 is disposed in a position corresponding to a lower portion of the cooling zone, a formed product charging port and a furnace gas outlet are disposed in a top portion of the carbonization furnace 2, and a carbon iron composite outlet is disposed in a lower portion of the carbonization furnace 2.

In production of carbon iron composite, a formed product of a carbon-containing substance and an iron-containing substance is fed with a formed product feeder 1 from the top portion of the vertical carbonization furnace main body 2, carbonized in the carbonization zone, cooled in the cooling zone, and discharged from the lower portion. A heating gas for the carbonization of the formed product is blown into the furnace through the low-temperature-gas-blowing tuyere 5 and the high-temperature-gas-blowing tuyere 6. The gas blown into the furnace through the high-temperature-gas-blowing tuyere 6 has a higher temperature than the gas blown into the furnace through the low-temperature-gas-blowing tuyere 5. A coolant gas for cooling carbon iron composite is blown into the furnace through the coolant-gas-blowing tuyere 9. The gas blown into the furnace is exhausted only through the furnace gas outlet in the top portion.

The furnace gas exhausted only from the top portion is cooled in circulating gas coolers 3 and 4. Part of the exhausted furnace gas is heated in a low-temperature gas heater 7 and blown into the furnace through the low-temperature-gas-blowing tuyere 5. Another part of the exhausted furnace gas is heated in a high-temperature gas heater 8 and blown into the furnace through the high-temperature-gas-blowing tuyere 6. The remainder of the exhausted furnace gas is blown into the furnace through the coolant-gas-blowing tuyere 9.

A formed product of a carbon-containing substance and an iron-containing substance is continuously carbonized to produce carbon iron composite in the vertical carbonization furnace having the three tuyeres disposed at different heights and no gas outlet other than the gas outlet in the top portion while a low-temperature gas is blown into the furnace through the tuyere disposed in the intermediate portion of the carbonization zone, a high-temperature gas is blown into the furnace through the tuyere disposed in the lower portion of the carbonization zone, and a coolant gas is blown into the furnace through the tuyere disposed in the lower portion of the cooling zone. Production of carbon iron composite in this manner can decrease the amount of heat required to produce carbon iron composite.

The low-temperature gas blown into the furnace through the low-temperature-gas-blowing tuyere 5 is blown to control the top gas temperature and the heating rate of the solid in the carbonization furnace and preferably has a temperature of approximately 400° C. to 700° C. The high-temperature gas blown into the furnace through the high-temperature-gas-blowing tuyere 6 is blown to heat the solid to the maximum temperature and preferably has a temperature of approximately 800° C. to 1000° C. The coolant gas blown into the furnace through the coolant-gas-blowing tuyere 9 is blown to cool carbon iron composite produced by carbonization in the furnace and preferably has a temperature of approximately 25° C. to 80° C.

The circumstances leading up to our methods and apparatus will be described in detail below. In the following description, the carbon-containing substance is a carbon material, coal, and the iron-containing substance is iron ore (ore).

In producing carbon iron composite, not only carbonization of coal, but also reduction of ore therein require heat. Thus, the operational specifications for production of formed coke cannot be employed without modification. The operational specifications for a vertical carbonization furnace in producing carbon iron composite were examined on the basis of studies on the basic characteristics of carbonization and reduction and simulation for a carbonization furnace based on the studies.

First, as basic characteristics, reduction behavior of iron ore was examined in the carbonization process of a formed product. Reduction of iron oxide in producing carbon iron composite can be broadly divided into direct reduction with solid carbon (see the following formula (1)) and gas reduction with CO gas and $H_2$ gas generated from coal (see the following formulae (2) and (3)):

$$Fe_2O_3+3C \rightarrow 2Fe+3CO\text{-}\Delta H_{298}=-676.1\ (\text{kcal/kg-}Fe_2O_3) \quad (1)$$

$$Fe_2O_3+3H_2 \rightarrow 2Fe+3H_2O\text{-}\Delta H_{298}=-142.5\ (\text{kcal/kg-}Fe_2O_3) \quad (2)$$

$$Fe_2O_3+3CO \rightarrow 2Fe+3CO_2\text{-}\Delta H_{298}=+42.0\ (\text{kcal/kg-}Fe_2O_3) \quad (3).$$

Direct reduction of the formula (1) involves a highly endothermic reaction.

Figure 3:
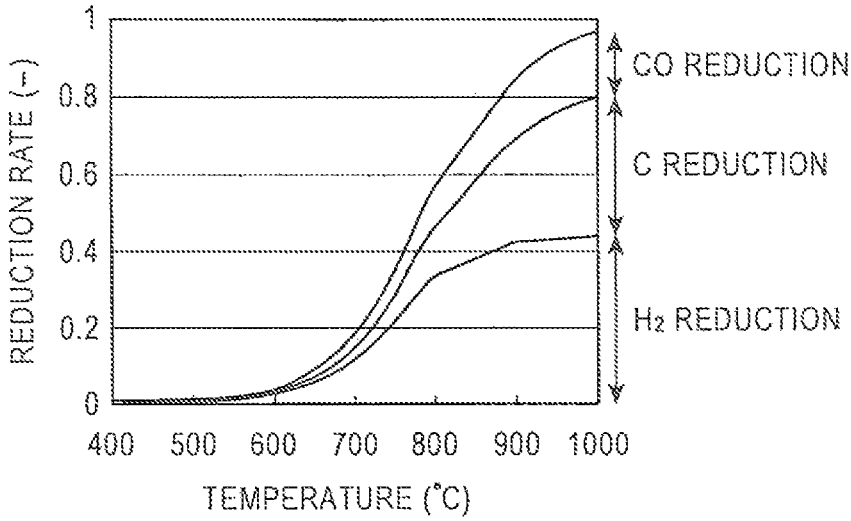
FIG. 3 is a graph showing the reduction of ore for each reaction in the carbon iron composite carbonization process.

A formed product of coal and iron ore was carbonized in a small batch furnace while $N_2$ flowed. The type of reduction was determined on the basis of the composition of exhaust gases. FIG. 3 shows the results. At a temperature of 800° C. or more, the percentage of the direct reduction with C (formula (1)) increases significantly, and the amount of endothermic heat during the reduction increases. Thus, the operational design for producing carbon iron composite must compensate for an endothermic reaction at a temperature of 800° C. or more.

Figure 4:
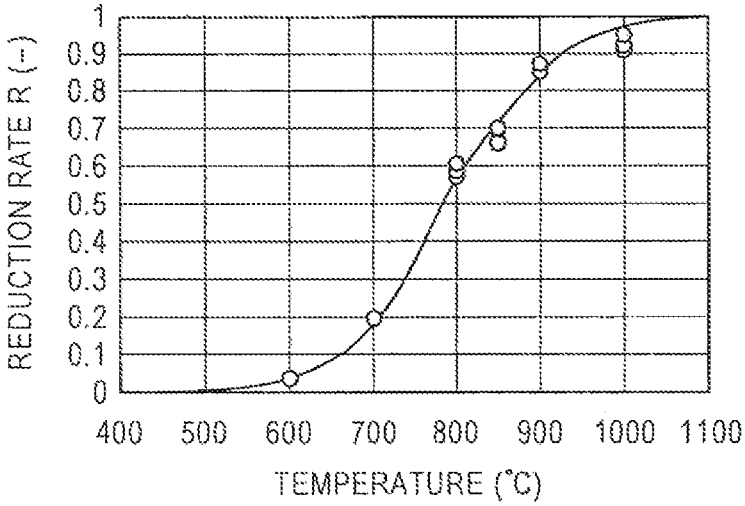
FIG. 4 is a graph showing the reduction rate of ore in the carbon iron composite carbonization process as a function of temperature.
Figure 5:
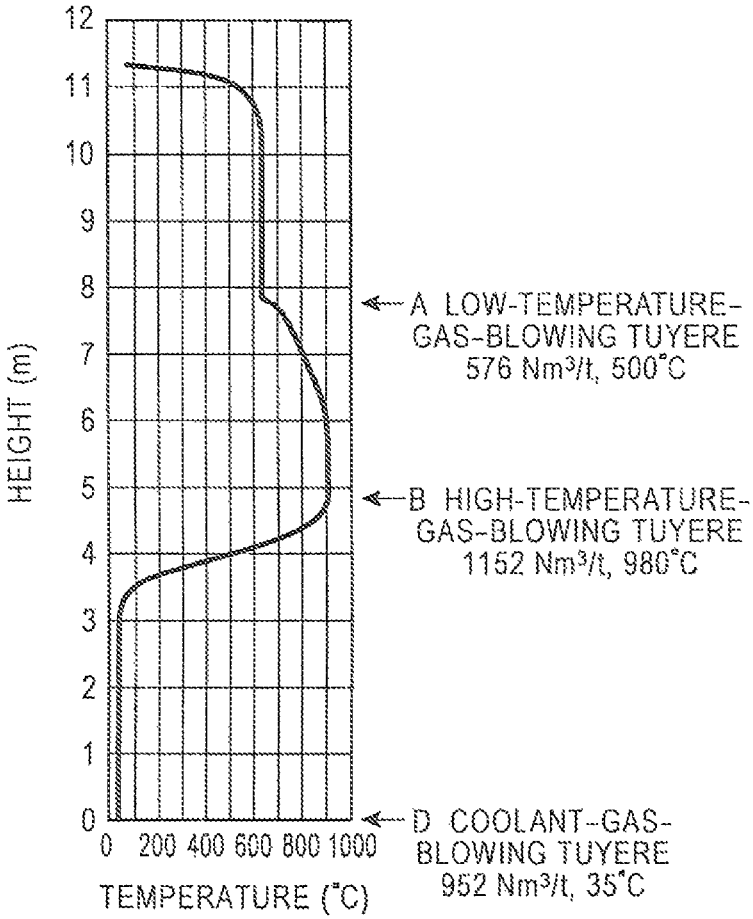
FIG. 5 is a graph showing the calculation results of the temperature distribution in our carbonization furnace.
Figure 6:
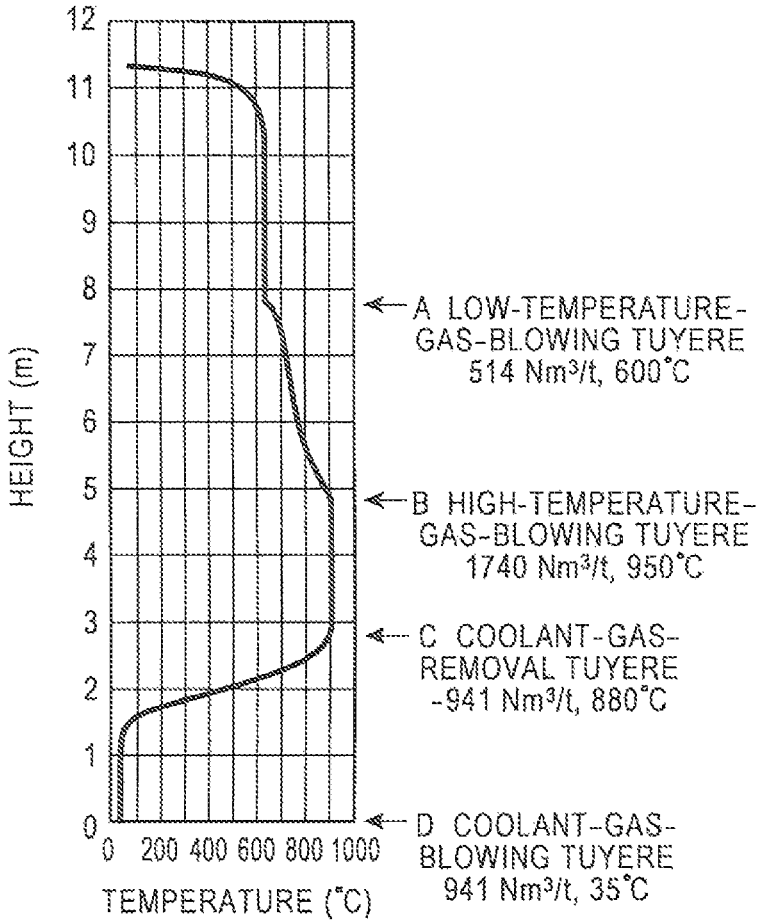
FIG. 6 is a graph showing the calculation results of the temperature distribution in a comparative carbonization furnace.

The temperature distribution of the furnace was estimated using a one-dimensional numerical formula model on the basis of the relationship shown in FIG. 3 and the relationship between the temperature and reduction rate shown in FIG. 4 determined by the experiment. FIG. 5 shows the calculation results for carbon iron composite production equipment without coolantgas-removal tuyere illustrated in FIG. 1. FIG. 6 shows the calculation results for conventional formed coke production equipment having the coolant-gas-removal tuyere 10 illustrated in FIG. 2. Gas conditions satisfying the target temperature distribution were determined such that a region having a temperature of 900° C. took one to two hours.

In FIG. 5, A denotes the position of the low-temperature-gas-blowing tuyere, and a gas having a temperature of 500° C. was blown into the furnace at 576 $Nm^3/t$. B denotes the position of the high-temperature-gas-blowing tuyere, and a gas having a temperature of 980° C. was blown into the furnace at 1152 $Nm^3/t$. D denotes the position of the coolant-gas-blowing tuyere, and a gas having a temperature of 35° C. was blown into the furnace at 952 $Nm^3/t$.

In FIG. 6, A denotes the position of the low-temperature-gas-blowing tuyere, and a gas having a temperature of 600° C. was blown into the furnace at 514 $Nm^3/t$. B denotes the position of the high-temperature-gas-blowing tuyere, and a gas having a temperature of 950° C. was blown into the furnace at 1740 $Nm^3/t$. C denotes the position of the coolant-gas-removal tuyere, and a gas having a temperature of 880° C. was removed at 941 $Nm^3/t$. D denotes the position of the coolant-gas-blowing tuyere, and a gas having a temperature of 35° C. was blown into the furnace at 941 $Nm^3/t$.

In the case of the conventional equipment having the coolant-gas-removal tuyere 10 illustrated in FIG. 2, to temporarily exhaust a gas blown through a lower portion of the furnace and heated to approximately 900° C. by heat exchange with a high-temperature carbonized formed product, the amount of heat required for a high-temperature portion of the carbonization zone must be supplied through the high-temperature-gas-blowing tuyere 6. Thus, the amount of gas blown through the high-temperature-gas-blowing tuyere 6 is higher than that for our equipment without coolant-gas-removal tuyere illustrated in FIG. 1.

Table 1 shows the ratio of the gas flow rate of the low-temperature-gas-blowing tuyere to the gas flow rate of the high-temperature-gas-blowing tuyere to produce formed coke with the conventional equipment as described in JP '234 illustrated in FIG. 2 and production of carbon iron composite examined above.

TABLE 1

| | | Carbon iron composite | |
|---|---|---|---|
| | Formed coke | With removal of coolant gas | Without removal of coolant gas |
| Low-temperature gas blowing tuyere | 1.88 | 0.30 | 0.50 |
| High-temperature gas blowing tuyere | 1.00 | 1.00 | 1.00 |

The amount of gas through the high-temperature tuyere is higher in producing carbon iron composite than in producing formed coke. This is because production of carbon iron composite requires a larger amount of heat in the high-temperature portion than production of formed coke because of reduction of ore. This clearly shows that even with the same vertical furnace the operational designs for producing conventional formed coke and producing carbon iron composite must be different.

The example described above considers the reuse (blowing into the furnace through each tuyere) of the top gas temporarily cooled to the vicinity of normal temperature. We prefer to circulate a gas exhausted from the vertical carbonization furnace. The top gas blown into the high-temperature-gas-blowing tuyere and the low-temperature-gas-blowing tuyere must therefore be heated to a predetermined temperature. This heating requires partial combustion of the top gas or combustion of fuel such as LNG, supplied from the outside. This process requires energy. Table 2 shows the sensible heat of gas blown through a tuyere in the presence or absence of the coolant-gas-removal tuyere illustrated in FIGS. 1 and 2 and FIGS. 5 and 6 with respect to 35° C.

TABLE 2

| | With coolant gas removal tuyere | Without coolant gas removal tuyere |
|---|---|---|
| Low-temperature gas blowing tuyere | — | 88 Mcal/t |
| High-temperature gas blowing tuyere | 531 Mcal/t | 358 Mcal/t |
| Total | 531 Mcal/t | 446 Mcal/t |

Energy corresponding to the sensible heat shown in Table 2 must be supplied from the outside. In both cases, the high-temperature gas is the top gas cooled to 35° C. and then heated in the outside of the furnace. In the absence of the coolant-gas-removal tuyere as illustrated in FIGS. 1 and 5, the low-temperature gas must be heated in the outside of the furnace. In the presence of the coolant-gas-removal tuyere as illustrated in FIGS. 2 and 6, a gas heated by heat exchange with coke is removed from the furnace and then blown into the furnace, thus obviating the necessity for heating in the outside of the furnace. The necessity for heating in the outside of the furnace is taken into account in Table 2. Thus, in the presence of the coolant-gas-removal tuyere, the sensible heat of gas in the low-temperature tuyere was 0 (–). As described above, in the presence of the coolant-gas-removal tuyere, the amount of gas blown through the high-temperature-gas-blowing tuyere must be increased. Even in no need of heating for the low-temperature tuyere, the total sensible heat of blown gas is higher in the presence of the coolantgas-removal tuyere than in the absence of the coolant-gas-removal tuyere. This indicates that much energy is required to heat a gas in the outside of the furnace. In conclusion, energy required in producing carbon iron composite is lower in the absence of the coolant-gas-removal tuyere illustrated in FIG. 1 than in the presence thereof.

In the case of a known vertical carbonization furnace used in a method for continuously producing formed coke in which a coolant gas is removed, a technique for producing carbon iron composite is also disclosed (see Japanese Unexamined Patent Application Publication No. 6-65579). However, blowing conditions and energy supplied are not specified. Our method for decreasing energy required for producing carbon iron composite was found as a result of examination of a difference in equipment structure, more specifically, the presence or absence of the coolant-gas-removal tuyere. Thus, our apparatus cannot be deduced from equipment structures having a coolant-gas-removal tuyere.

EXAMPLE 1

Figure 7:
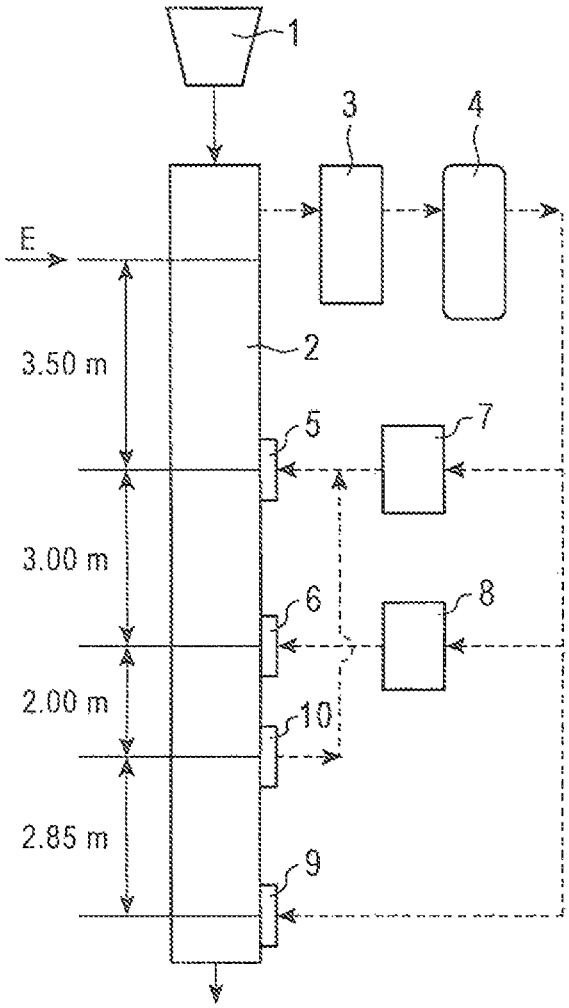
FIG. 7 is a schematic view of an apparatus used in the production test of carbon iron composite in an example.

The test production of carbon iron composite was performed with a test apparatus for producing carbon iron composite illustrated in FIG. 7 in the presence or absence of a coolant-gas-removal tuyere 10. A vertical carbonization furnace had a cross-sectional area of 1.67 $m^2$. In accordance with the related art described in JP '234 in which a coolant gas inlet has a smaller cross-sectional area than a high-temperature-gas inlet, when a coolant gas is not removed, the coolant gas selectively flows through the central portion of the furnace in the high-temperature-gas inlet, resulting in poor mixing of a high-temperature gas and the coolant gas. In our apparatus, a coolant gas inlet had the same cross-sectional area as a high-temperature-gas inlet to improve gas mixing. Furthermore, a formed product as an carbon iron composite raw material was sieved to remove a powder having a particle size of 10 mm or less and fragments of the formed product. The sieved formed product was fed into a carbonization furnace while maintaining high air permeability of the packed bed. This facilitated the flow of the high-temperature gas through the packed bed.

Table 3 shows the operational specifications for an carbon iron composite production volume of 50 t/d. The target carbonization temperature ranged from 800° C. to 950° C., and the temperature of a high-temperature blast from a high-temperature-gas-blowing tuyere was altered. The carbonization temperature is the mean value of temperatures measured during the operation at heights of 0.1 and 1 m with respect to the high-temperature tuyere. Table 3 also shows the reduction rate of iron and percentage of metallization in carbonized carbon iron composite measured for each condition.

TABLE 3

| | | Without removal of coolant gas | | | | With removal of coolant gas | | |
|---|---|---|---|---|---|---|---|---|
| Low-temperature gas blowing tuyere | ° C. | 480 | 480 | 480 | 480 | 600 | 600 | 600 |
| | $Nm^3$/hr | 1200 | 1200 | 1200 | 1200 | 1071 | 1071 | 1071 |
| High-temperature gas blowing tuyere | ° C. | 890 | 930 | 980 | 1020 | 850 | 910 | 960 |
| | $Nm^3$/hr | 2400 | 2400 | 2400 | 2400 | 3625 | 3625 | 3625 |
| Coolant gas removal tuyere | ° C. | — | — | — | — | 770 | 830 | 880 |
| | $Nm^3$/hr | — | — | — | — | 0 | 3625 | 3625 |
| Coolant gas blowing tuyere | ° C. | 35 | 35 | 35 | 35 | 35 | 35 | 35 |
| | $Nm^3$/hr | 1979 | 1979 | 1979 | 1979 | 1960 | 1960 | 1960 |
| Carbonization temperature | ° C. | 801 | 853 | 905 | 958 | 800 | 854 | 900 |
| Reduction rate of iron ore in carbon iron composite | % | 45 | 72 | 88 | 92 | 46 | 71 | 87 |
| Percentage of metallization of iron ore in carbon iron composite | % | 25 | 65 | 83 | 89 | 26 | 64 | 81 |

At a carbonization temperature of 800° C. or more, the reduction rate is 40%, and the percentage of metallization is more than 25%, indicating that iron ore in the carbon iron composite is reduced to form metallic iron.

Regardless of the presence or absence of the coolant-gas-removal tuyere 10, carbon iron composite thus produced had a target strength without any problem in the production. Table 4 shows the amount of heat required to increase the temperature of gases blown through the low-temperature-gas-blowing tuyere and the high-temperature-gas-blowing tuyere for each condition. The definition is the same as described above, that is, the sensible heat of gas blown through each tuyere with respect to 35° C.

TABLE 4

| | | Without removal of coolant gas | | | | With removal of coolant gas | | |
|---|---|---|---|---|---|---|---|---|
| Carbonization temperature | ° C. | 801 | 853 | 905 | 958 | 800 | 854 | 900 |
| Low-temperature gas blowing tuyere | Mcal/hr | 184 | 184 | 184 | 184 | 0 | 0 | 0 |
| High-temperature gas blowing tuyere | Mcal/hr | 677 | 711 | 745 | 780 | 965 | 1042 | 1106 |
| Total | Mcal/hr | 861 | 895 | 929 | 964 | 965 | 1042 | 1106 |

Figure 8:
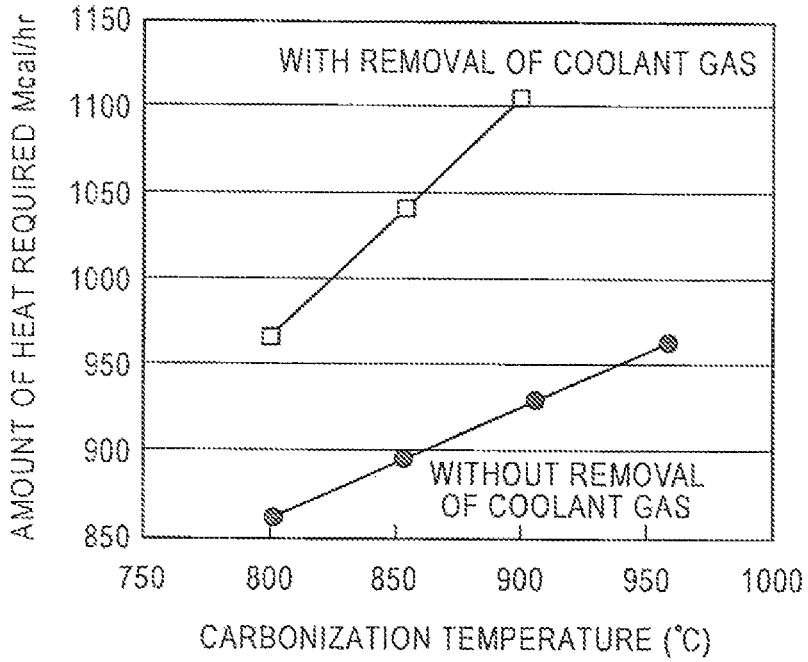
FIG. 8 is a graph showing the relationship between the carbonization temperature and the amount of heat required to increase the temperatures of a low-temperature gas and a high-temperature gas.

FIG. 8 shows the relationship between the carbonization temperature and the total amount of heat required (necessary heat) to increase the temperatures of the low-temperature gas and the high-temperature gas. If the lower limit condition of the carbonization temperature is 800° C., the amount of heat required is approximately 860 Mcal/h or more without removal of the coolant gas and 965 Mcal/h or more with removal of the coolant gas. Also at a temperature of 800° C. or more, the amount of heat required in the presence of removal of the coolant gas is larger than that in the absence of removal of the coolant gas for the same carbonization temperature. The difference in the amount of heat between them increases with the temperature of carbonization. Thus, at a carbonization temperature of 800° C. or more at which iron ore in carbon iron composite was reduced to form metallic iron, the conditions in the absence of removal of the coolant gas required a smaller amount of heat to increase the temperature of gas than the conditions in the presence of removal of the coolant gas and required smaller energy consumption in the production of carbon iron composite than the conditions in the presence of removal of the coolant gas.

What is claimed is:

1. A method for producing carbon iron composite comprising:

providing a carbonization furnace having a top portion, a carbonization zone in an upper portion, and a cooling zone in a lower portion;

feeding a formed product of a carbon-containing substance and an iron-containing substance into the carbonization furnace;

carbonizing the formed product in the carbonization zone to produce carbon iron composite;

blowing a coolant gas into the furnace through a coolant-gas-blowing tuyere disposed in the cooling zone to cool the carbon iron composite;

exhausting a furnace gas through an outlet in the top portion; and discharging the carbon iron composite through the lower portion of the cooling zone, wherein the carbonization comprises:

forming the coolant gas from the furnace gas in a gas cooler, heating the coolant gas to form a cooling gas, and supplying heated coolant gas to the carbonization zone after cooling the carbon iron composite in the cooling zone, forming the coolant gas from the furnace gas in a gas cooler and supplying heated coolant gas to the carbonization zone after cooling the carbon iron composite in the cooling zone, blowing a high-temperature gas into the furnace through a high-temperature-gas-blowing tuyere disposed in a lower portion of the carbonization zone, and blowing a low-temperature gas into the furnace through a low-temperature-gas-blowing tuyere disposed in an intermediate portion of the carbonization zone.

2. The method according to claim 1, wherein the furnace gas is exhausted only through the outlet in the top portion.

3. The method according to claim 1, further comprising supplying the furnace gas exhausted through the outlet in the top portion to the low-temperature-gas-blowing tuyere.

4. The method according to claim 1, further comprising supplying the furnace gas exhausted through the outlet in the top portion to the high-temperature-gas-blowing tuyere.

5. The method according to claim 1, wherein the gas blown into the furnace through the low-temperature-gas-blowing tuyere has a temperature of 400° C. to 700° C.

6. The method according to claim 1, wherein the gas blown into the furnace through the high-temperature-gas-blowing tuyere has a temperature of 800° C. to 1000° C.

7. The method according to claim 1, wherein the gas blown into the furnace through the coolant-gas-blowing tuyere has a temperature of 25° C. to 80° C.

8. A method for producing carbon iron composite comprising:

providing a carbonization furnace having a top portion, a carbonization zone in an upper portion, and a cooling zone in a lower portion;

feeding a formed product of a carbon-containing substance and an iron-containing substance into the carbonization furnace;

carbonizing the formed product in the carbonization zone to produce carbon iron composite;

supplying a furnace gas exhausted through an outlet in the top portion as coolant gas and blowing the coolant gas into the furnace through a coolant-gas-blowing tuyere disposed in the cooling zone to cool the carbon iron composite;

exhausting the furnace gas through the outlet in the top portion; and discharging the carbon iron composite through the lower portion of the cooling zone, wherein the carbonization comprises:

supplying the coolant gas after the coolant gas has undergone heat exchange with the carbon iron composite in the cooling zone to the carbonization zone, blowing a high-temperature gas into the furnace through a high-temperature-gas-blowing tuyere disposed in a lower portion of the carbonization zone, and blowing a low-temperature gas into the furnace through a low-temperature-gas-blowing tuyere disposed in an intermediate portion of the carbonization zone.

9. A method for producing carbon iron composite comprising:

providing a carbonization furnace having a top portion, a carbonization zone in an upper portion, and a cooling zone in a lower portion;

feeding a formed product of a carbon-containing substance and an iron-containing substance into the carbonization furnace;

carbonizing the formed product in the carbonization zone to produce carbon iron composite;

blowing a coolant gas into the furnace through a coolant-gas-blowing tuyere disposed in the cooling zone to cool the carbon iron composite;

exhausting a furnace gas through an outlet in the top portion; and discharging the carbon iron composite through the lower portion of the cooling zone, wherein the carbonization comprises:

supplying the coolant gas after the coolant gas has undergone heat exchange with the carbon iron composite in the cooling zone to the carbonization zone, blowing a high-temperature gas into the furnace through a high-temperature-gas-blowing tuyere disposed in a lower portion of the carbonization zone, blowing a low-temperature gas into the furnace through a low-temperature-gas-blowing tuyere disposed in an intermediate portion of the carbonization zone, and supplying the furnace gas exhausted through the outlet in the top portion to the low-temperature-gas blowing tuyere, the high-temperature-gas blowing tuyere and the coolant gas blowing tuyere.

* * * * *